US006280259B1

(12) United States Patent
Stollburges

(10) Patent No.: US 6,280,259 B1
(45) Date of Patent: Aug. 28, 2001

(54) LINK FOR AN ELECTRICAL MOUNTING RACK TERMINAL WITH TWO BUSBARS, AND MOUNTING RACK TERMINAL

(75) Inventor: Martin Stollburges, Paderborn (DE)

(73) Assignee: Gerd Conrad and Heinrich Hölscher, Paderborn (DE)

( * ) Notice: Subject to any disclaimer, the term of this patent is extended or adjusted under 35 U.S.C. 154(b) by 0 days.

(21) Appl. No.: 09/525,819

(22) Filed: Mar. 15, 2000

(51) Int. Cl.[7] ..... H01R 9/22
(52) U.S. Cl. ..... 439/715
(58) Field of Search ..... 439/835, 709, 439/715, 716, 856, 857

(56) References Cited

FOREIGN PATENT DOCUMENTS 0 735 629 A1 10/1996 (EP) .

0 763 874 A2 3/1997 (EP) .

*Primary Examiner*—Gary Paumen
*Assistant Examiner*—Phuongchi Nguyen
(74) *Attorney, Agent, or Firm*—Herbert L. Lerner; Laurence A. Greenberg; Werner H. Stemer

(57) ABSTRACT

A link for an electrical mounting rack terminal has two elongate, adjacent spring contacts which are held firmly against one another at a first end portion and can move resiliently at a second end portion. The link is latched to a housing of the electrical mounting rack terminal. A first embodiment of the link terminates flush with an outer contour of the housing. A second embodiment of the link has a grasping portion which protrudes beyond the outer contour of the housing. An electrical mounting rack terminal is also provided.

20 Claims, 6 Drawing Sheets

LINK FOR AN ELECTRICAL MOUNTING RACK TERMINAL WITH TWO BUSBARS, AND MOUNTING RACK TERMINAL

BACKGROUND OF THE INVENTION

1. Field of the Invention

The invention relates to a link for an electrical mounting rack terminal which has two busbars one above the other. The invention also concerns a mounting rack terminal fitted with a link according to the invention.

Published European Patent Application EP 0 763 874 A2 discloses an electrical mounting rack terminal having a link, in which the busbars are disposed one above the other and have plug openings which are oriented so as to be aligned with one another and into which a link can be plugged for electrical connection. The link essentially includes two spring contacts which lie flat against one another and, in the region of their lower contact zone, which interacts with the lower busbar, or in their upper contact zone, which interacts with the plug opening in the upper busbar, have mutually complementary or opposite offsets. The spring contacts are held against one another at their upper ends above the upper contact zone such that they can be displaced. On entering the plug opening in the lower busbar, the two spring contacts are resiliently braced against one another in the plug openings.

Since, in the case of the above-described conventional link, contact is made virtually exclusively via the lateral narrow edges of the spring contacts, the contact area is disadvantageously small and may cause excessive heating.

In addition, Published European Patent Application EP 0 735 629 A1 discloses a terminal having a vertically oriented busbar, with a transverse link with which internal contact is made as a result of spreading or forcing the link apart.

SUMMARY OF THE INVENTION

It is accordingly an object of the invention to provide a link for an electrical mounting rack terminal which overcomes the above-mentioned disadvantages of the heretofore-known links of this general type and which has a space-saving configuration, which is simple to produce and which also has an enlarged contact area. It is furthermore an object of the invention to provide an electrical mounting rack terminal.

With the foregoing and other objects in view there is provided, in accordance with the invention, a link for an electrical mounting rack terminal having a first busbar and a second busbar positioned at a distance from the first busbar, the first busbar being formed with a plug opening, the second busbar having a clamping web, the link including:

two elongate, adjacent spring contact members, having respective first end portions, respective second end portions opposite from the respective first end portions, the spring contact members being held firmly against one another at the first end portions and being resiliently movable at the second end portions;

the spring contact members having a central region between the first end portions and the second end portions, an upper contact zone in the central region of the spring contact members and a lower contact zone at the second end portions;

each of the spring contact members having a first offset region provided at the upper contact zone and having a second offset region provided at the lower contact zone, the first and the second offset regions providing an enlarged spacing between the spring contact members at the upper and lower contact zones; and the spring contact members having an exterior region at the upper contact zone and an interior region at the lower contact zone, the spring contact members being configured to provide a pressure contact when inserted into the plug opening of the first busbar such that the exterior region at the upper contact zone forms a contact to the first busbar, the spring contact members being configured to interact with the clamping web and being configured to be spread apart at the lower contact zone for forming a contact to the second bus bar at the interior region.

The spring contact members are preferably made of metal wire with a rectangular cross section.

In accordance with another feature of the invention, the first end portion of each spring contact member is provided with an offset and with neighboring lateral cut-away portions, so that two spring contacts can be connected so as to engage in one another in a formfitting manner.

Preferably, an electrically insulating grip part is provided on the first end portion. The grip part can be made of plastic. The grip part preferably encloses the spring contacts.

The first end portion of each spring contact is expediently provided with a cutout for latching or locking the grip part to the first end portion.

The second end portion of each spring contact preferably has lateral chamfers to facilitate plugging the link into an electrical mounting rack terminal.

The two spring contacts are preferably identical and produced by punching or stamping.

In accordance with a further feature of the invention, the link can be latched or locked to a housing of the mounting rack terminal, wherein the housing holds the first and second busbars and the link. When the link is latched, the region of the link's first end portion terminates essentially flush with an outer contour of the housing, so that the link cannot be grasped from the outside when inserted. In this case, the link cannot be pulled out without the use of force or without partially destroying it, so that the two busbars are permanently connected to one another.

According to an alternative feature of the invention, the link can be latched or locked to a housing of the mounting rack terminal, wherein the housing holds the first and second busbars and the link. When the link is latched, the region of the link's first end portion protrudes beyond an outer contour of the housing by a grasping portion, so that, when inserted, the link can be grasped from the outside by the grasping portion and can be pulled out.

According to a further feature of the invention, the grip part may be provided with a latch which interacts with the housing of the mounting rack terminal. The link may be provided with a grasping portion. The grasping portion can be provided with at least one grasping projection which can interact with a tool.

With the objects of the invention in view there is also provided, an electrical mounting rack terminal, including:

a first busbar formed with a plug opening;

a second busbar positioned at a distance from the first busbar and having a clamping web;

a link including two elongate, adjacent spring contact members, the spring contact members having respective first end portions, respective second end portions opposite from the respective first end portions, the spring contact members being held firmly against one another at the first end portions and being resiliently movable at the second end portions;

the spring contact members having a central region between the first end portions and the second end portions, an upper contact zone in the central region of the spring contact members and a lower contact zone at the second end portions;

each of the spring contact members having a first offset region provided at the upper contact zone and having a second offset region provided at the lower contact zone, the first and the second offset regions providing an enlarged spacing between the spring contact members at the upper and lower contact zones; and the spring contact members having an exterior region at the upper contact zone and an interior region at the lower contact zone, the spring contact members providing a pressure contact when inserted into the plug opening of the first busbar such that the exterior region of the upper contact zone forms a contact to the first busbar, the spring contact members interacting with the clamping web and being configured to be spread apart at the lower contact zone for forming a contact to the second bus bar at the interior region.

Other features which are considered as characteristic for the invention are set forth in the appended claims.

Although the invention is illustrated and described herein as embodied in a link for an electrical mounting rack terminal which has two busbars one above the other, and in a mounting rack terminal fitted with a link according to the invention, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
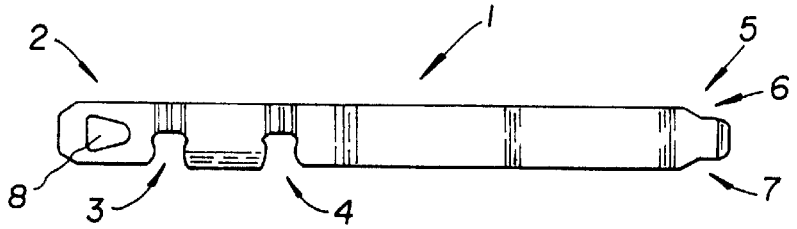
FIG. 1 is a top plan view of a spring contact for a link according to the invention.
Figure 2:
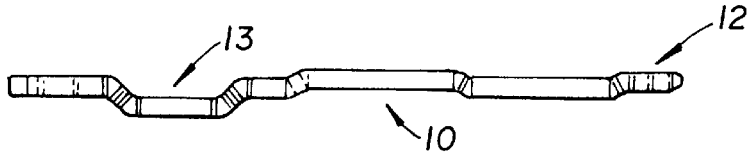
FIG. 2 is a side view of the spring contact shown in FIG. 1.
Figure 3:
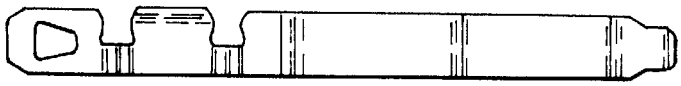
FIG. 3 is a bottom plan view of the spring contact shown in FIG. 1.

Referring now to the figures of the drawings in detail and first, particularly, to FIGS. 1 to 4 thereof, there are shown various views of a first spring contact or spring contact member 1 produced by punching or stamping from a piece of wire material with a rectangular cross section. The plan views shown in FIGS. 1 and 3 show that a first end portion 2 of the spring contact is provided with a central cutout 8 and also has two cut-away portions 3 and 4 which are open at the side. The second, opposite end portion 5 of the spring contact is provided with two lateral chamfers 6 and 7.

As FIG. 2 shows in a side view, the spring contact 1 is provided with a total of three different offsets, namely with a first offset 10 in its central region, a second offset 12 in the region of the second end portion 5 and with a third offset 13 in the region of the first end portion 2 between the cut-away portions 3 and 4.

FIG. 3 shows a plan view from the side opposite to that shown in FIG. 1 and is thus a mirrored view.

Figure 4:
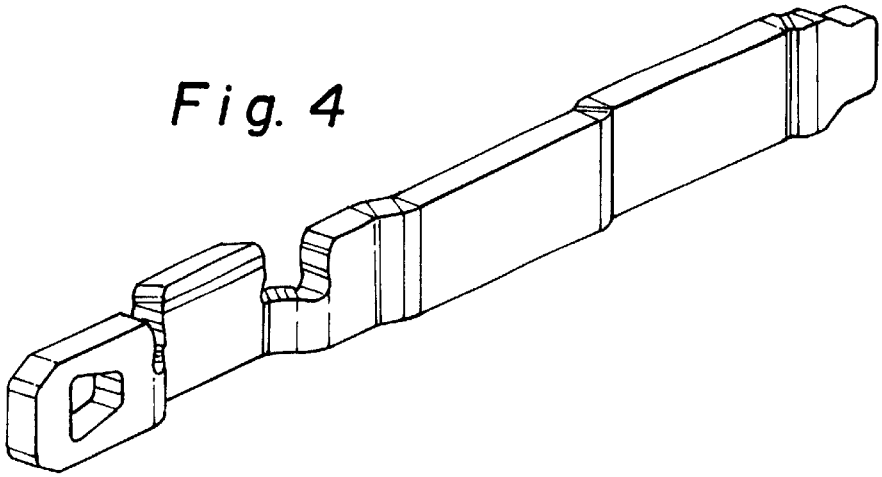
FIG. 4 is a perspective view of the spring contact shown in FIGS. 1 to 3 on an enlarged scale.
Figure 5:
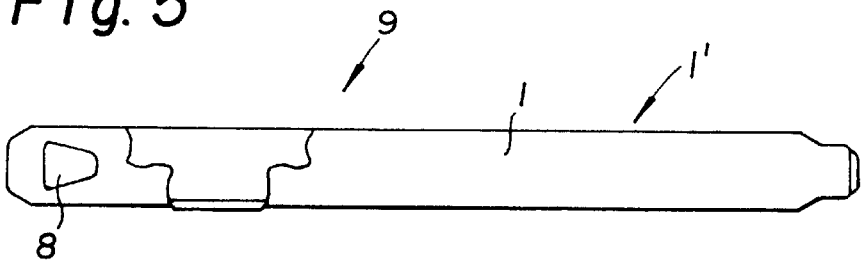
FIG. 5 is a top plan view of a link according to the invention, which includes two spring contacts.

FIG. 4 shows a perspective view of the features of an individual spring contact explained above.

FIGS. 5 to 8 show a link or connector piece 9 which is formed from two assembled spring contacts 1, 1'. The spring contacts 1 and 1' are identical and correspond to the illustrations according to FIGS. 1 to 4.

Figure 6:
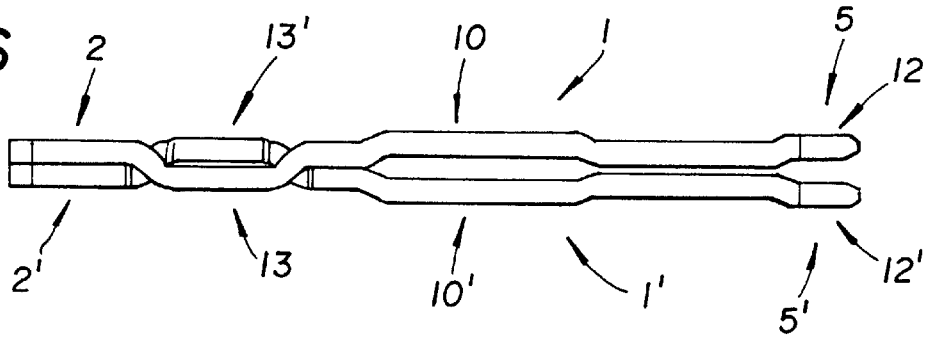
FIG. 6 is a sid e view of a link as shown in FIG. 5.
Figure 7:
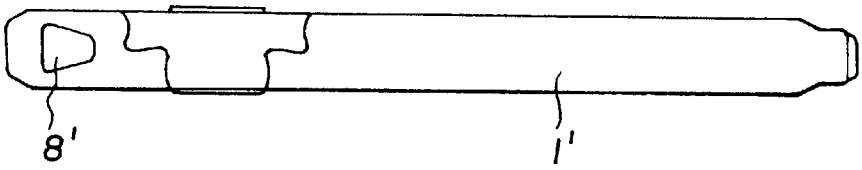
FIG. 7 is a bottom plan view of a link as shown in FIG. 5.

As shown in particular by FIG. 6, the two spring contacts 1, 1' are firmly connected to one another in the region of their first end portions 2, 2' as a result of their third offsets 13, 13' and cut-away portions 3, 3', 4, 4' engaging in one another.

As FIG. 6 also shows, the spring contacts 1, 1' have an enlarged spacing from one another in their central region, on account of the first offsets 10, 10', and at the second end portions 5, 5', on account of the second offsets 12, 12'. In this case, the outer surfaces of the spring contacts in the region of the offsets 10, 10' form an upper contact zone, while the inner surfaces of the spring contacts in the region of the offsets 12, 12' form a lower contact zone.

Figure 8:
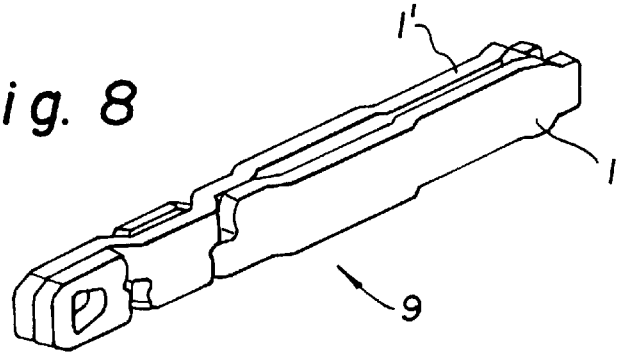
FIG. 8 is a perspective view of the link shown in FIGS. 5 to 7.
Figure 9:
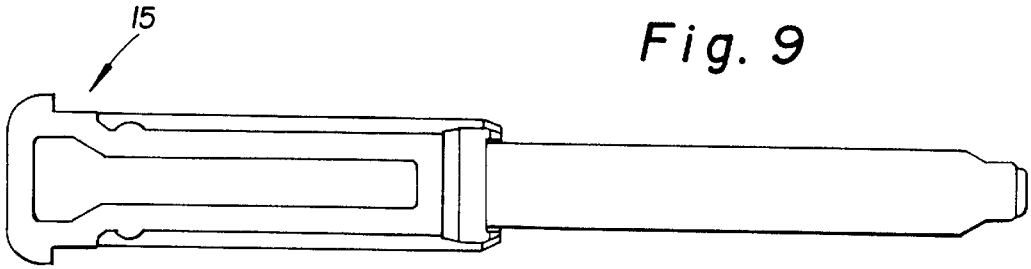
FIG. 9 is a top plan view of a link according to the invention with a grip part.
Figure 10:
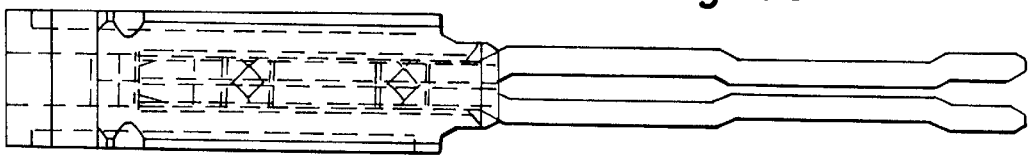
FIG. 10 is a side view of the link with a grip part, as shown in FIG. 9, the grip part region being illustrated in a schematic sectional view.
Figure 11:
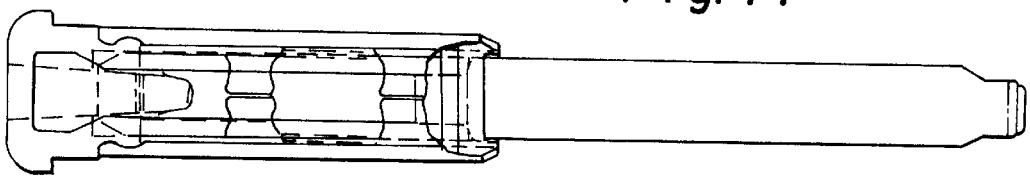
FIG. 11 is a partially sectional top view of the link shown in FIG. 9.

FIG. 8 illustrates in a perspective view the link 9 formed from two spring contacts.

FIGS. 9 to 12 show a link, formed from two spring contacts as shown in FIGS. 1 to 8, which, in order to improve handling, safety and reliability of operation, is additionally provided with a plastic grip part 15 which encloses the two spring contacts 1, 1' in the region of their first end portions 2, 2'. In the region of the cutouts 8, 8', the grip part 15 is provided with two projections which latch into the cutouts 8, 8' and ensure fixing when the grip part is pushed onto the link.

Figure 12:
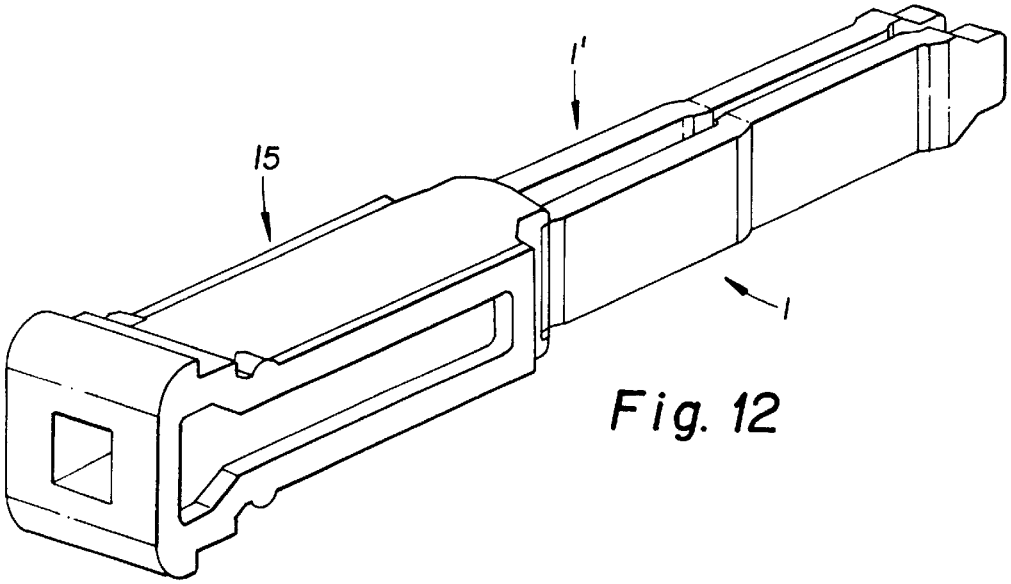
FIG. 12 is a perspective view of the link with a grip part as shown in FIGS. 9 to 11.

FIG. 12 shows a perspective illustration of the link according to the invention together with the plastic grip part 15.

Figure 13:
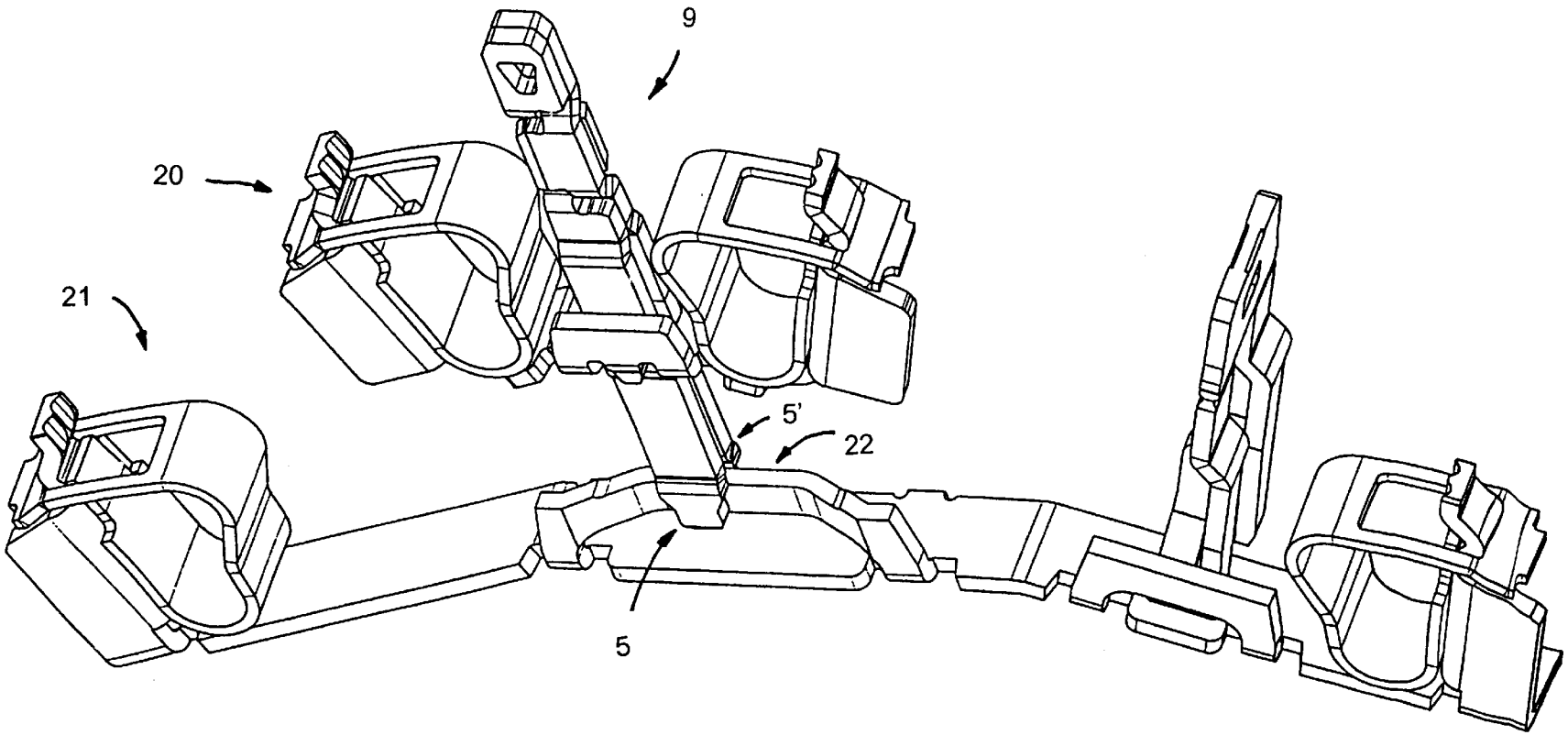
FIG. 13 is a perspective view of two busbars, disposed one above the other, of a mounting rack terminal with an inserted link in accordance with the invention.

FIG. 13 shows two busbars or conductor rails 20 and 21 disposed one above the other, this configuration being equivalent to that in a conventional electrical mounting rack terminal or subframe terminal. The central region of the upper busbar 20 is provided with a rectangular plug opening which is used for plugging in a link 9 according to the invention, while the central region of the lower busbar 21 has a clamping web 22 which is resiliently clasped by the two free end portions 5, 5' of the link's spring contacts.

The width of the plug opening in the upper busbar 20 essentially corresponds to the width of the spring contacts 1, 1', and its height essentially corresponds to the height of the link in the region of the offsets 10 and 12. This allows the link to be inserted into the plug opening without using any significant force, until the free end portions 5, 5' are located at the level of the clamping web 22. The clear spacing between the spring contacts in the region of the offsets 12, 12' (FIG. 6, FIG. 10) is smaller than the thickness of the clamping web 22, so that the link's spring contacts are bent apart elastically when the end portions 5, 5' are pushed onto the clamping web 22. This movement produces an outwardly directed pressing force for the spring contacts against the inner surfaces of the plug opening in the region of the plug opening, i.e. at the level of the first offsets 10, 10', so that good contact conditions are produced both in the region of the upper busbar, or of the upper contact zone, and in the region of the lower busbar, or of the lower contact zone.

Figure 14:
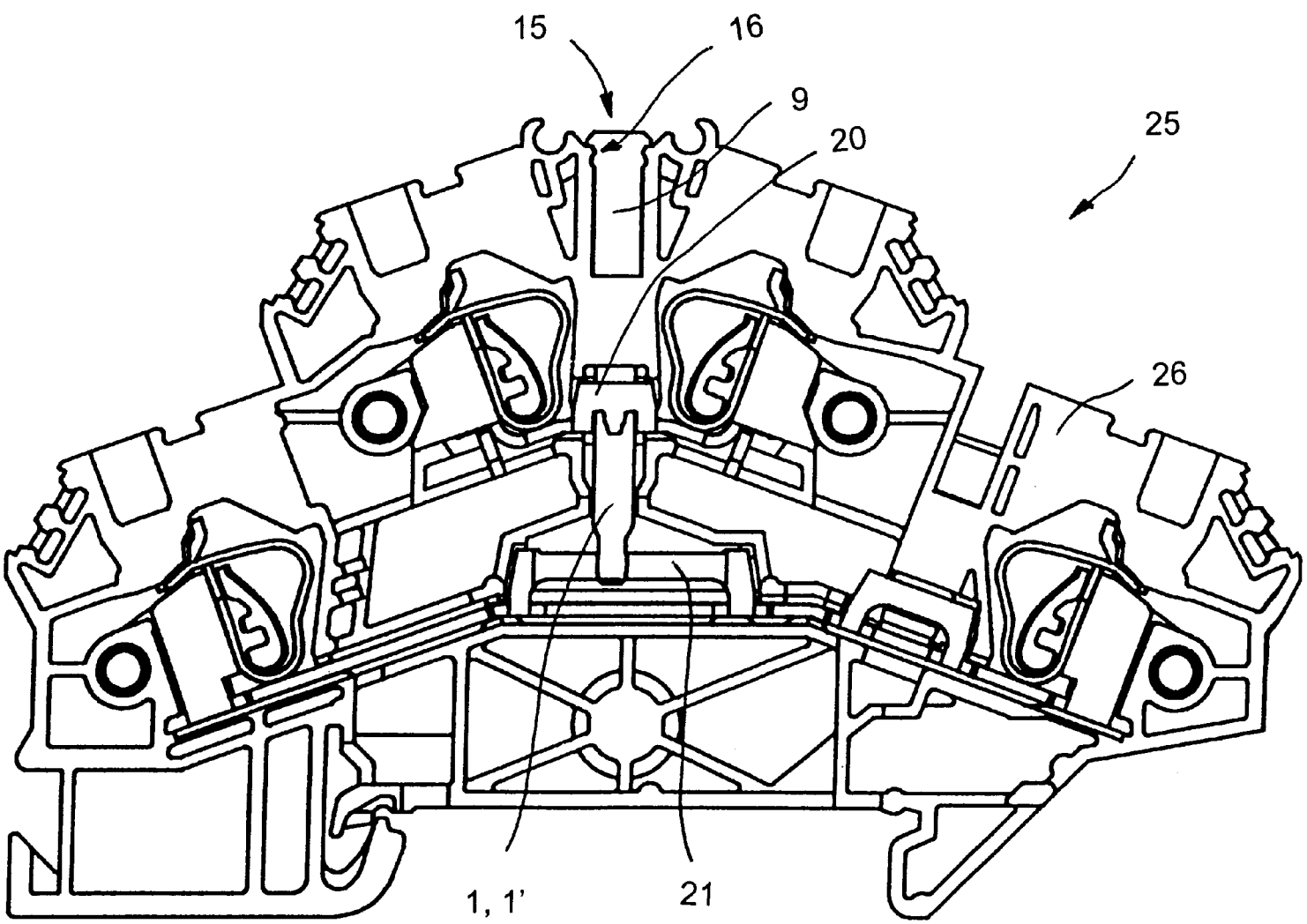
FIG. 14 is a plan view of a mounting rack terminal with an inserted link.

FIG. 14 shows a plan view of a mounting rack terminal 25 which holds, in a housing 26, which is injection-molded from plastic, an upper busbar 20 and a lower busbar 21 which can be connected to one another by a link 9 according to the invention. The link 9 electrically connects the two busbars 20, 21 to one another through the use of its spring contacts 1, 1' and has an insulating grip part 15 made of plastic on its opposite end portion.

In the region of its end portion, the grip part 15 is provided with latching or locking devices 16 which interact with complementary latching or locking devices in the housing 26, so that the grip part 15, or the link 9, is firmly latched to the housing 26 when inserted.

Since the end portion of the link, or of the grip part 15, as FIG. 14 shows, virtually does not protrude beyond the outer contour of the housing 26, or terminates essentially flush with the latter, the link, when inserted, can no longer be grasped easily and pulled out of the housing, particularly when a plurality of similar mounting rack terminals are positioned next to one another on a support bar, as is customary in practice. The link shown in FIG. 14 thus allows a permanent or fixed electrically conductive connection between the two busbars 20, 21 by inserting the link either before or after the mounting rack terminal is installed. The connection can no longer be easily released after the link is inserted.

Figure 15:
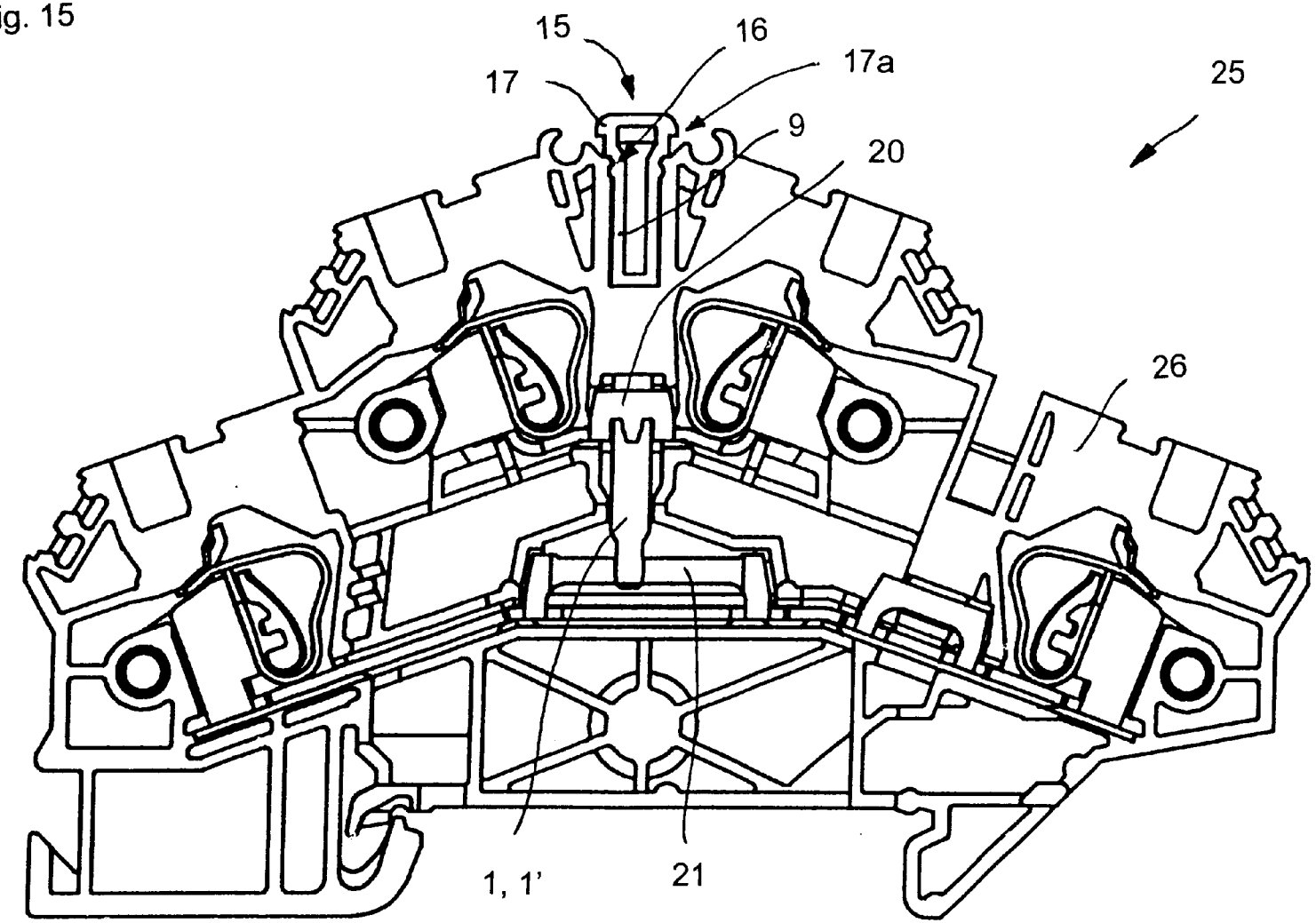
FIG. 15 is a plan view of a mounting rack terminal with a modified link.

FIG. 15 shows a view corresponding to that of FIG. 14, wherein a second embodiment of the link is provided with a grip part 15 which has a grasping portion 17 which protrudes beyond the outer contour of the housing 26 of the mounting rack terminal 25. In this case too, the grip part 15 is provided with latching devices 16 which interact with corresponding latching devices in the housing 26, so that the link 9 is held firmly in the housing 26. The grasping attachment or portion 17, which is provided with grasping projections 17*a* for interaction with a tool, for example a screwdriver, allows the link 9 to be removed from the housing 26 again at any time, even after insertion, should this be desired for particular reasons.

The embodiments shown in FIGS. 14 and 15 thus allow the option of providing both embodiments of the link (with and without grasping attachment 17) for one particular, unchanged embodiment of mounting rack terminals 25, or for a particular housing 26 of the mounting rack terminals. Thus, depending on the application, both, the mounting rack terminals in which the two busbars are permanently connected to one another and the mounting rack terminals in which the busbars are not or are releasably connected to one another can be provided without requiring any particular action or production measures.

I claim:

1. A link for an electrical mounting rack terminal having a first busbar and a second busbar positioned at a distance from the first busbar, the first busbar being formed with a plug opening, the second busbar having a clamping web, comprising:

two elongate, adjacent spring contact members, having respective first end portions, respective second end portions opposite from said respective first end portions, said spring contact members being held firmly against one another at said first end portions and being resiliently movable at said second end portions;

said spring contact members having a central region between said first end portions and said second end portions, an upper contact zone in said central region of said spring contact members and a lower contact zone at said second end portions;

each of said spring contact members having a first offset region provided at said upper contact zone and having a second offset region provided at said lower contact zone, said first and said second offset regions providing a first spacing between said spring contact members at said upper and lower contact zones and a second spacing between said spring contact members between said upper contact zone and said lower contact zone, the first spacing being larger than the second spacing, said first and second spacings being in a direction normal to a blank of metal from which said spring contact members have been formed; and said spring contact members having outside surfaces at said upper contact zone and inside surfaces at said lower contact zone, said spring contact members being configured to provide a pressure contact when inserted into a plug opening of a first busbar such that said outside surfaces at said upper contact zone form a contact to the first busbar, said spring contact members being configured to interact with a clamping web and being configured to be spread apart by the clamping web at said lower contact zone for forming a contact to a second bus bar at said inside surfaces.

2. The link according to claim 1, wherein said spring contact members are metal wire spring contact members having a rectangular cross section.

3. The link according to claim 1, wherein said first end portions each have a respective third offset region and are formed with lateral cut-away portions adjacent to said third offset region such that said spring contact members are engageable with one another for forming a formfitting connection.

4. The link according to claim 1, wherein each of said second end portions has lateral chamfers.

5. The link according to claim 1, wherein said two spring contact members are identical.

6. The link according to claim 1, wherein said spring contact members are punched spring contact members.

7. The link according to claim 1, wherein said spring contact members are adapted to be latched to a housing of the electrical mounting rack terminal holding the first and second busbars and said spring contact members, said first end portions configured to terminate essentially flush with an outer contour of the housing such that said spring contact members cannot be grasped from outside after being inserted and latched.

8. The link according to claim 1, including a grasping portion provided at said first end portions, one of said grasping portion and said spring contact members adapted to be latched to a housing of the electrical mounting rack terminal holding the first and second busbars and said spring contact members, said grasping portion configured to protrude beyond an outer contour of the housing such that said grasping portion can be grasped and said contact spring members can be pulled out from the housing.

9. The bridge according to claim 8, wherein said grasping portion has at least one grasping projection for interacting with a tool.

10. The link according to claim 1, including an electrically insulating grip part disposed at said first end portions.

11. The link according to claim 10, wherein said grip part is a plastic grip part.

12. The link according to claim 10, wherein said grip part encloses said spring contact members.

13. The link according to claim 10, wherein each of said first end portions is formed with a cutout for latching with said grip part.

14. The link according to claim 10, wherein said grip part is adapted to be latched to a housing of the electrical mounting rack terminal holding the first and second busbars, said spring contact members and said grip part, said grip part being configured to terminate essentially flush with an outer contour of the housing such that said grip part cannot be grasped from outside after being inserted and latched.

15. The link according to claim 10, wherein said grip part is provided with latches for interacting with a housing of the mounting rack terminal.

16. An electrical mounting rack terminal, comprising:

a first busbar formed with a plug opening;

a second busbar positioned at a distance from said first busbar and having a clamping web;

a link including two elongate, adjacent spring contact members, said spring contact members having respective first end portions, respective second end portions opposite from said respective first end portions, said spring contact members being held firmly against one another at said first end portions and being resiliently movable at said second end portions;

said spring contact members having a central region between said first end portions and said second end portions, an upper contact zone in said central region of said spring contact members and a lower contact zone at said second end portions;

each of said spring contact members having a first offset region provided at said upper contact zone and having a second offset region provided at said lower contact zone, said first and said second offset regions providing a first spacing between said spring contact members at said upper and lower contact zones and a second spacing between said spring contact members between said upper contact zone and said lower contact zone, the first spacing being larger than the second spacing, said first and second spacings being in a direction normal to a blank of metal from which said spring contact members have been formed; and said spring contact members having outside surfaces at said upper contact zone and inside surfaces at said lower contact zone, said spring contact members providing a pressure contact when inserted into said plug opening of said first busbar such that said outside surfaces of said upper contact zone form a contact to said first busbar, said spring contact members interacting with said clamping web and being configured to be spread apart by said clamping web at said lower contact zone for forming a contact to said second bus bar at said inside surfaces.

17. The electrical mounting rack terminal according to claim 16, including a housing having an outer contour and holding said first busbar and said second busbar, said spring contact members adapted to be latched to said housing, said first end portions configured to terminate essentially flush with said outer contour of said housing such that said spring contact members cannot be grasped from outside after being inserted and latched.

18. The electrical mounting rack terminal according to claim 16, including:

an electrically insulating grip part disposed at said first end portions;

a housing having an outer contour and holding said first busbar and said second busbar; and said grip part adapted to be latched to said housing and configured to terminate essentially flush with said outer contour of said housing such that said grip part cannot be grasped from outside after being inserted and latched.

19. The electrical mounting rack terminal according to claim 16, including:

a housing having an outer contour and holding said first busbar and said second busbar; and a grasping portion provided at said first end portions, one of said grasping portion and said spring contact members adapted to be latched to said housing, said grasping portion configured to protrude beyond said outer contour of said housing such that said grasping portion can be grasped and said contact spring members can be pulled out from said housing.

20. The electrical mounting rack terminal according to claim 16, including:

an electrically insulating grip part disposed at said first end portions and having latches; and a housing holding said first busbar and said second busbar and having mating latches interacting with said latches of said grip part.

* * * * *